United States Patent [19]

Badolato et al.

[11] Patent Number: 4,609,975

[45] Date of Patent: Sep. 2, 1986

[54] EYEGLASS DISPLAY CASE

[75] Inventors: Vincent G. Badolato, Oswego Summit, #47, Lake Oswego, Oreg. 97034; Billy G. Epperson, Aloha, Oreg.

[73] Assignee: Vincent G. Badolato, Lake Oswego, Oreg.

[21] Appl. No.: 648,035

[22] Filed: Sep. 6, 1984

[51] Int. Cl.[4] ..... A47F 11/10

[52] U.S. Cl. ..... 362/125; 362/311; 211/13; 211/131; 211/194; 248/DIG. 2

[58] Field of Search ..... 211/163, 131, 13, 194, 211/71; 362/125, 135, 367, 154, 269, 311, 277; 248/DIG. 2

[56] References Cited

U.S. PATENT DOCUMENTS

| | | | |
|---|---|---|---|
| 165,018 | 6/1875 | Millmann | 312/125 |
| 503,306 | 8/1893 | Bever | 312/252 |
| 910,381 | 1/1909 | Hermann | 128/374 |
| 1,619,248 | 3/1927 | Donathan | 221/122 |
| 1,631,002 | 5/1927 | Bowman et al. | 62/441 |
| 1,695,463 | 12/1928 | Lipschutz | 221/63 |
| 1,717,943 | 6/1929 | Smith | 312/125 |
| 1,846,878 | 2/1932 | Kopp | 362/125 |
| 2,936,897 | 5/1960 | Bloch | 211/13 |
| 3,891,092 | 6/1975 | Surrette et al. | 211/13 |
| 3,955,681 | 5/1976 | Dezinno | 211/13 |
| 4,140,223 | 2/1979 | Rau et al. | 211/78 |
| 4,157,760 | 6/1979 | Wilson | 211/163 |
| 4,180,921 | 1/1980 | Elbaum et al. | 434/405 |
| 4,204,602 | 5/1980 | Dunchock | 211/13 |
| 4,211,331 | 7/1980 | Salmon et al. | 211/13 |

FOREIGN PATENT DOCUMENTS

| | | | |
|---|---|---|---|
| 4167772 | 11/1973 | Australia | 211/13 |
| 2315052 | 10/1973 | Fed. Rep. of Germany . | |
| 268287 | 1/1933 | Italy . | |
| 1582913 | 1/1981 | United Kingdom | 211/131 |
| 2068723 | 8/1981 | United Kingdom . | |

*Primary Examiner*—Charles J. Myhre
*Assistant Examiner*—David A. Okonsky
*Attorney, Agent, or Firm*—Kolisch, Hartwell & Dickinson

[57] ABSTRACT

An apparatus for storing and displaying eyeglasses is provided. The apparatus includes a first module having a central axis and including a plurality of radially extending, circumferentially spaced compartments, the compartments defining a plurality of radially extending compartments therebetween. Also included are display panels which are disposed within the spaces.

20 Claims, 5 Drawing Figures

EYEGLASS DISPLAY CASE

BACKGROUND OF THE INVENTION

This invention relates generally to an eyeglass display case. More particularly, the invention relates to a modular apparatus for storing and displaying sunglasses.

For many years sunglasses have been displayed in retail establishments by means of carrousel-type display cases having typically two or four sides for holding different styles of sunglasses. One such case is disclosed in U.S. Pat. No. 4,211,331 to Salmon et al. Such display cases have been satisfactory for displaying a limited inventory in a relatively attractive apparatus. However, there are many limitations inherent with this type of display. One serous drawback is that once a single pair of glasses is purchased off of the display, the store clerk typically has no way of determining which glasses have been purchased and therefore which glasses should be replaced. If the clerk is able to somehow determine which glasses have been purchased, replacement inventory is typically not at hand and therefore can be time consuming to remount on the display. The clerk will typically not realize that a particular style of glasses has been depleted until no more can be found. Because of the inconvenience of relacing displayed inventory, conventional displays are often as much as one-third to one-half empty at any particular time. This reduces sales per square foot and resulting profits to the store owner.

Another limitation with conventional carrousel-type display cases is that such displays often take up too much space to justify use during the winter season. This is undesirable because a certain amount of sunglasses are salable during the winter to minimize snow glare during driving, winter sports, and the like.

Conventional sunglass display cases are sometimes lit only by ambient lighting sources. While this is sometimes satisfactory, such lighting does not illuminate the sunglasses in such a way as to place them in their best perspective. Specifically, it is highly desirable that some means be provided for directing light outwardly from the display case through the sunglass lenses so that the lenses and frames are highlighted.

It would be highly desirable if a sunglass display case could be shipped fully loaded with suitable inventory. The problem with such shipment is normally that a limited inventory is typically provided on the display case, and such inventory is mounted externally, thereby subjecting the sunglasses to damage during shipment.

Yet another problem with conventional carrousel-type display cases is that display panels are often permanently mounted thereon, making it inconvenient to change advertising or other displays without disassembly of the entire case.

Hence, it is a primary object of the present invention to provide an improved sunglass display case which effectively and reliably overcomes the aforementioned limitations and drawbacks of the prior art proposals. More specifically, the present invention has as its objects one or more of the following:

(1) to provide a sunglass display case in which inventory may be stored adjacent a sunglass display panel, and in which such inventory and display panel may be identified to facilitate replacement upon sale of a particular pair of glasses;

(2) to develop a modular carrousel-type display case which may be disassembled without the use of tools or expertise on the part of the operator, in order to increase or decrease the size of the display as dictated by consumer demand;

(3) to provide a lighting system for a modular sunglass display case which permits downsizing or upsizing of the display without causing replacement of the lighting system;

(4) the provision of a lighting system for a sunglass display case which directs light outwardly through the display and through the glasses displayed thereon, thereby highlighting the features of each pair of glasses;

(5) to develop a carrousel-type display case in which the exterior panels thereof are easily removable to facilitate the changing of advertising, identification information and the like thereon;

(6) to provide a display case in which inventory may be shipped as well as stored within the retail establishment; and (7) to provide a sunglass display case which is simple and therefore inexpensive to fabricate, and which holds a substantial number of sunglasses to maximize the potential profit per square foot of floor or counter space.

SUMMARY OF THE INVENTION

The invention responds to the problems presented in the prior art by providing an apparatus for storing and displaying eyeglasses at retail establishments. The apparatus includes a first module having a central axis and including a plurality of radially extending, circumferentially spaced, compartments, the compartments defining a plurality of radially extending spaces therebetween. Display means for the glasses are disposed within such spaces. The display means are normally at least translucent to light so that light directed from adjacent the central axis passes through the display means and any eyeglass disposed thereon. The phrase "at least translucent" means that the display means should not be opaque, but should be translucent or transparent. Additional modules may be nested onto the first module as needed, such that their central axes coincide.

Inventory control identification means on the compartments and the display means makes possible the coordination of the location of particular eyeglass inventory and display cases.

DETAILED DESCRIPTION OF THE PREFERRED EMBODIMENT

Figure 1:
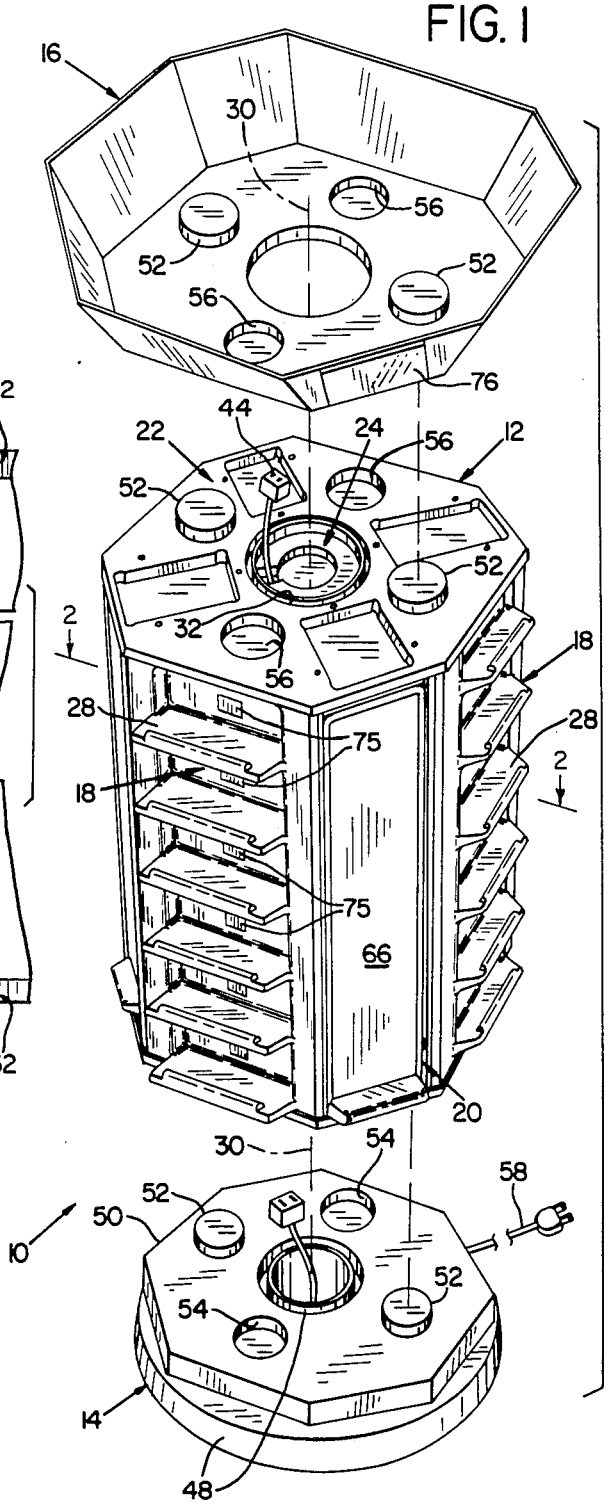
FIG. 1 is an exploded, perspective view of a first embodiment of the present invention.

A first embodiment of the present invention, which is generally indicated with the numeral 10, has been depicted in Figs. 1, 3, 4 and 5. Apparatus 10 includes a first module 12, a base 14 and a top 16. The module, which will be described in more detail below, is provided with a plurality of sunglass display panels 18 having sunglass receptacles 28 thereon, a plurality of inventory storage compartments 20, and means for nesting module 12 with other modules, with top 16 or with base 14. The nesting means is generally identified with the numeral 22. Also included in module 12 is lighting means 24 for lighting up the module and sunglasses 26 displayed thereon.

Figure 2:
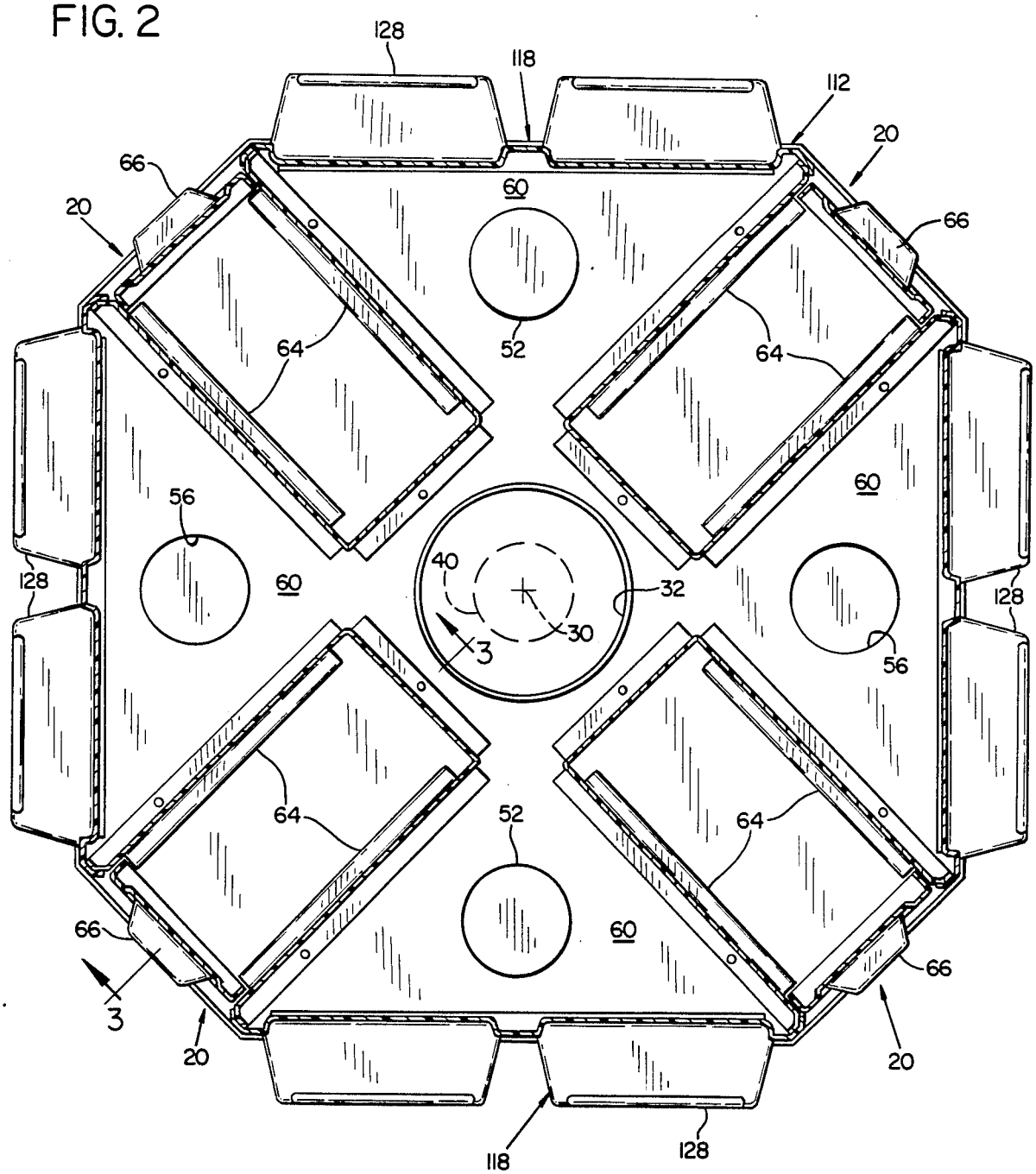
FIG. 2 is an enlarged, sectional plan view of a second embodiment as if it were taken along line 2—2 of FIG. 1, this embodiment coinciding with the first embodiment except that two stacks or columns of glasses may be displayed in each display panel.

A second embodiment of the module of the present invention is depicted in FIG. 2 and has been identified with the numeral 112. This module 112 is basically the same as module 12 except that each display panel 118 includes two stacks or columns of sunglass receptacles 128. Because the remaining components are the same as those of module 12, identification numerals corresponding to module 12 have been used.

Modules 12 and 112 are generally octagonal in cross section, with four minor sides being defined by the radially extending inventory compartments 20, and the major sides being defined by the four display panels 18 and 118 disposed between the inventory compartments. The sides defined by display panels 18 and 118 are normally wider than those of inventory copartments 20. Each module 12 and 112 includes a central axis 30 and a generally cylindrical channel 32 which extends around axis 30 to define a chamber to receive lighting means 24. Lighting means 24, which is depicted in some detail in FIG. 4, includes a lower platform 34, an upper platform 36, and circumferentially spaced rods 38 and a channel member 39 which extend between the platforms. Rods 38 and channel member 39 are of a length corresponding the height of modules 12 and 112. An incandescent light bulb 40, a male electrical plug component 42, and a female electrical plug component 44, are also provided. Alternatively, a fluoroescent bulb may be used. In any event, the cord extending between the male and female plug components and the light bulb is normally fastened to channel member 39 to prevent contact with the light source such as bulb 40. Modules 12 and 112 are adapted to be utilized with a plurality of similar modules in a nesting, stacked arrangement, and this is the purpose of both a male and a female electrical plug component 42 and 44. Lower platform 34 of lighting means 24 includes a female nesting element 46, while upper platform 36 includes a male nesting element, which does not show in the drawings but which corresponds to a male nesting element 46 extending upwardly from base 14. In this way, lighting means of individual modules may be mounted one upon the other, depending on how many modules are to be included within a particular display case.

Base 14 includes a stationary lower portion 48 and a rotatable upper portion 50. Upper portion 50 includes nesting means which correspond to the nesting means 22 in the upper and lower portion of modules 12 and 112. Such nesting means typically includes a pair of radially opposed, cylindrical upwardly extending members 52 and a pair of radially opposed, round openings 54 which are adapted to receive downwardly extending cylindrical members 56 of module 12, such as those shown in FIGS. 1, 2 and 4. The fit between the nesting components is such that the apparatus does not wobble, slip or rattle as the display is turned. The male electrical plug component 42 of lighting means 24, which extends through female nesting element 46 of lower platform 34 and male nesting element 48 in lower portion 48 of base 14, is typically connected to a female electrical plug portion (not shown) of an extension cord 58 which extends outwardly through an aperture (not shown) in the lower portion of the base.

With this lighting construction, upper portion 50 of base 14 is permitted to rotate, thereby causing modules 12 and 112 to rotate with it. Lighting means 24 and their associated cords do not rotate, so that entanglement of the cords does not result during such rotation. There is a relatively loose fit between the lower and upper platforms 34 and 36 and the module 12 and 112 with which they are associated so that free rotation of the modules is permitted.

The nesting means of apparatus 10 enables the deletion of a center support pole which is often found in conventional carouseltype display cases. This is because support is provided by the modules 12 and 112 themselves. Because of the nesting relationship, the customer can turn any module and the entire apparatus, except for the stationary portion of base 14, will turn.

As shown best in FIG. 2, inventory compartments 20 are radially spaced at both their inner and outer ends so that light being directed radially outwardly from lighting means 24 will pass between the compartments and through spaces 60. Display panels 18 and 118 are formed of translucent material such as high impact polystyrene which has preferably been treated with an ultra violet inhibitor to prolong the life of apparatus 10 against yellowing and cracking. Thus, light radiating outwardly from lighting means 24 passes through the display panels to light up sunglasses 26 mounted within each display panel receptacle 28 or 128. This highlights sunglass lenses and their frames to an extent exceeding prior art designs.

Figure 4:
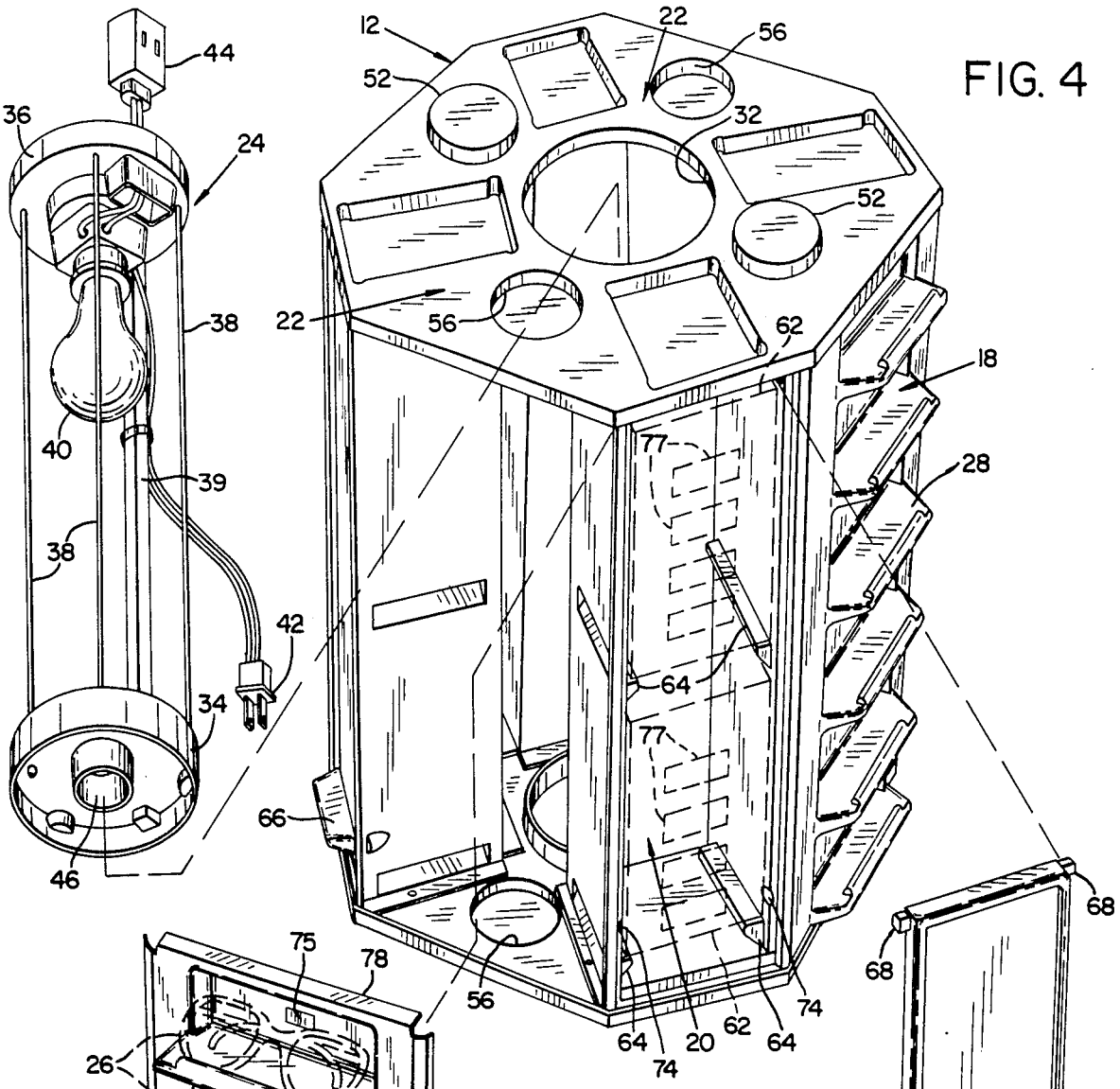
FIG. 4 is a perspective exploded view of the module portion of FIG. 1.

Each inventory compartment 20 is typically rectangular in cross section and is adapted to receive a stack of inventory boxes 62 such as those shown in FIG. 4. Inventory compartments 20 may be provided with shelves (not shown) or other supporting means such as ribs 64 shown in FIG. 4. Such supporting means permits a box of sunglass inventory to be displayed in the receptacle 28 immediately adjacent to the display of that same pair of sunglasses. This is true regardless of whether any of the inventory boxes 62 have been discarded.

Figure 3:
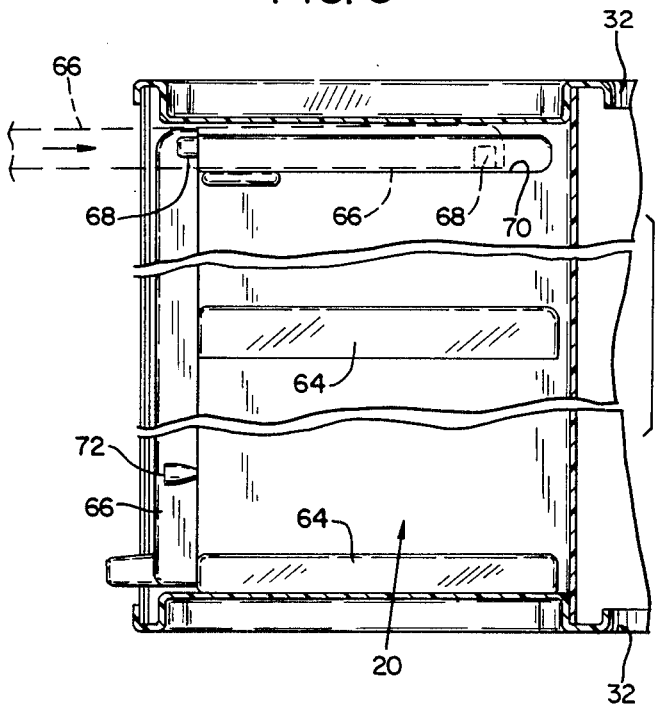
FIG. 3 is a sectional view taken along 3—3 of FIG. 2 showing the pivotal characteristic of an inventory compartment door.

Pivotable panels 66 are mounted to each of the inventory compartments 20 so that they will be closed during normal display, but may be pivoted open on a pair of nibs 68 which mount into complementing channels 70 disposed immediately above each compartment. The presence of channels 70, rather than a pair of apertures into which nibs 68 might be placed, permits panels 66 to be pivoted upwardly, and then pushed rearwardly into an inventory compartment 20, as depicted in FIG. 3. This makes it possible for the store clerk to handle inventory boxes 62 with greater ease because the pivotable panel 66 does not have to be held up out of the way. To maintain panels 66 in their closed position during rotation of apparatus 10, a pair of detents 72 with complementing recessed portions 74 are provided so that each of the panels is held shut until intended to be opened. Panels 66 typically include information describing the sunglasses 26 in the adjacent receptacles, and the uses for which such glasses are designed. The described construction makes it easy to remove and replace panels when advertising or identification information on the panel is to be changed.

Figure 5:
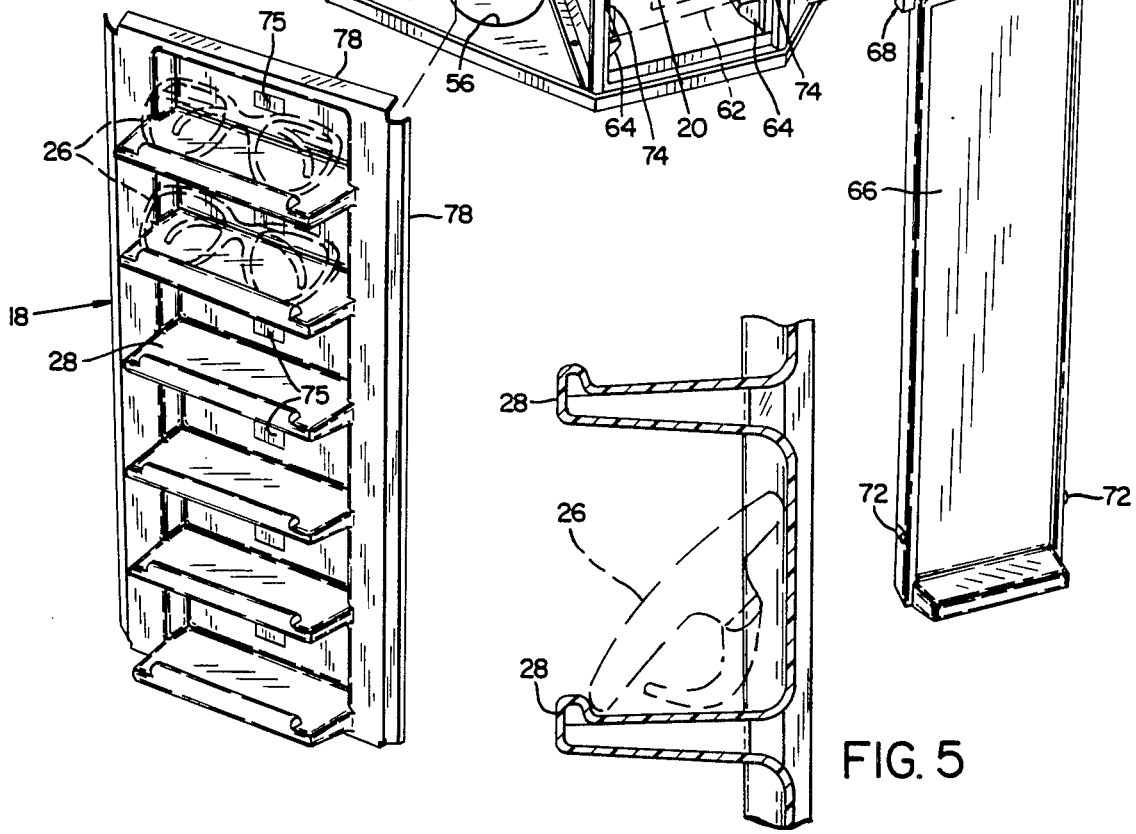
FIG. 5 is a fragmentary sectional view taken along line 5—5 of FIG. 4.

A pair of sunglass receptacles 28 or 128 are shown in cross section in FIG. 5. These receptacles 28 or 128 permit sunglasses 26 to be maintained in an upright position such that light passing through the display panels 18 and 118 will pass through the lenses of the glasses. The receptacles include recessed portions which tend to protect the displayed glasses against accidental dislodgement such as when someone bumps into the apparatus. The forwardly extending portion of receptacle 28 also gives the customer something to hold onto to turn the display. Thus, he does not have to grasp the glasses themselves to effect turning, as he might have to with some prior art designs.

To facilitate inventory control, each receptacle 28 and 128 is typically numbered or lettered at 75, with corresponding numbering or lettering 77 being provided in the boxes 62 disposed within the inventory control compartments 20. Thus, when a clerk notes that a particular pair of sunglasses 26 has been removed from the receptacle 28 or 128, it is easy to determine which particular design has been removed, and the adjacent panel 66 may be opened to find a replacement pair from the box 62 immediately adjacent that receptacle. Thus, inventory control problems associated with prior designs have been overcome. Moreover, substantial inventory of sunglasses may be shipped in apparatus 10, in a stored away, concealed and protected location.

As shown in FIG. 1 and mentioned above, apparatus 10 includes a top 16. This top is of conventional design in that it flares outwardly and upwardly, and includes mirrored portions such as that indicated at 76. Top 16 nests into the upper most module 12 or 112 of the apparatus with a pair of upwardly and downwardly extending cylindrical members 52 and 56.

As mentioned above, apparatus 10 is typically formed of lightweight, high impact polystyrene which is injection molded using conventional techniques. The components are adapted to clip together using complementing peripheral portions such as those shown in FIG. 4 at 78. This construction enables removal and replacement of damaged parts of the apparatus. It also simplifies replacement of light bulb 40 so that the entire apparatus does not have to be disassembled. Finally it facilitates re-design of various components without replacement of the entire apparatus 10.

The depicted embodiment includes only a single module 12 or 112 although it will be appreciated that several additional modules may be mounted within any particular apparatus. The nesting characteristic of modules 12 and 112 permits mounting of one module to another without the use of tools or expertise on the part of the person assembling the units. Thus, apparatus 10 may be comprised of two or three or more modules during the summer time and may be floor mounted to maximize display capacity. In the winter time, a single module may be utilized, and the apparatus 10 may be adapted for mounting on a countertop. In any event, regardless of the number of modules utilized, lighting means 24 may be used without requiring any special components. As additional modules are added, a corresponding number of lighting means can be put into place. Apparatus 10 thus provides an attractive, efficient, inexpensive means for a superior display of product while providing the retail establishment with a means for inventory control not found in prior systems.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

It is claimed and desired to secure by Letters Patent:

1. Apparatus for storing and displaying eyeglasses, comprising:

a first module having a central axis and including a plurality of radially extending, circumferentially spaced storage compartments for non-displayed storage of eyeglass inventory, said compartments defining a plurality of radially extending spaces therebetween; and display means for glasses disposed within said spaces.

2. The apparatus of claim 1 wherein said display means includes a plurality of receptacles defining recessed portions, flat shelf portions and forwardly extending portions.

3. The apparatus of claim 1, further comprising a second module having a central axis, a plurality of radially extending, circumferentially spaced compartments defining a plurality of radially extending spaces, and means for mounting said first and second modules to one another such that their axes coincide.

4. The apparatus of claim 3 wherein said storage compartments comprise eyeglass inventory storage compartments having eyeglasses disposed therein.

5. The apparatus of claim 1, further comprising a second module having a central axis and a plurality of radially extending, circumferentially spaced compartments defining a plurality of radially extending spaces; and means for nesting said first and second modules, one into the other, with said central axes coaxial.

6. The apparatus of claim 5, wherein said compartments of each said module define a central channel extending parallel to said axes, and further comprising first and second light means disposed within said channels in said first and second module, respectively, so that a single light means and its module can be removed without rendering the light means for the other module inoperable.

7. The apparatus of claim 5, further comprising a base having rotatable means thereon, said rotatable means having nesting means complementing said module nesting means so that either of said modules nests into said base.

8. The apparatus of claim 1, wherein said compartments comprise inventory storage compartments and said compartments and said display means include inventory control identification means for coordinating the location of particular eyeglass inventory and display pieces.

9. The apparatus of claim 8 wherein said compartments include replaceable cover panels for display of inventory control identification means.

10. The apparatus of claim 8, wherein said inventory storage compartments retain inventory containers with inventory therein, said containers including inventory control identification means thereon.

11. The apparatus of claim 1 wherein said display means is at least translucent to light so that light directed from adjacent said central axis passes through said display means and any eyeglasses disposed thereon.

12. The apparatus of claim 11 wherein said compartments further define a central channel extending parallel to said axis, and further comprising light means disposed within said channel for directing light radially outwardly through said display means.

13. The apparatus of claim 12 wherein said module is generally octagonal in cross section, with four compartments and four spaces disposed therebetween.

14. The apparatus of claim 12 wherein said light means comprises a light bulb mounting having a height which is no greater than that of said module.

15. The apparatus of claim 12 wherein said light means comprises a light bulb mounting, the apparatus further comprising a base having stationary and rotatable portions, said stationary portion including means for mounting said light bulb mounting thereto, and said rotatable portion including means for mounting said module thereto.

16. The apparatus of claim 15, further comprising a second module having:

a central axis;

radially extending storage compartments:

means for mounting said second module to said first module such that said axes coincide;and a top, said top including means for mounting to an upper portion of one of said modules.

17. An apparatus for displaying eyeglasses, comprising:

a first module having a central axis and a central channel extending parallel to said axis;

first light means disposed within said channel for directing light radially outwardly;

first display means disposed radially outwardly from said channel for supporting and displaying eyeglasses, said display means being at least translucent to light so that light from said light means passes therethrough to light up any eyeglasses disposed on said display means; and first storage compartment means for non-displayed storage of inventory, said compartment means being disposed radially outwardly from said channel alternately interspersed with said display means.

18. The apparatus of claim 17, further comprising a base having a stationary portion and a rotatable portion, said light means including means for being stationarily mounted to said stationary portion, and said first module including means for mounting with said rotatable portion to rotate therewith.

19. The apparatus of claim 18 further comprising a second module having a central axis and a central channel extending parallel to said axis, second light means within said second module channel, second display means disposed radially outwardly from said channel, second storage compartment means for non-displayed storage of inventory, said compartment means being disposed radially outwardly from said channel alternately interspersed with said display means, means for mounting said second module above said first module such that their axes coincide, and means for mounting said second light means above said first light means; and wherein the height of said first light means is no greater than that of said first module, and the height of said second light means is no greater than that of said second module.

20. The apparatus of claim 19, further comprising a plurality of eyeglasses mounted to each of said first and second display means.

* * * * *